US009414679B2

(12) United States Patent
Lapointe et al.

(10) Patent No.: US 9,414,679 B2
(45) Date of Patent: Aug. 16, 2016

(54) FURNITURE MEMBER SEATBACK LINKAGE WITH SELECTABLE FASTENER LOCATIONS FOR ADJUSTING SEATBACK ANGLE

(71) Applicant: La-Z-Boy Incorporated, Monroe, MI (US)

(72) Inventors: Larry P. Lapointe, Temperance, MI (US); Eric B. Harwood, Toledo, OH (US); Richard D. Hartford, Maybee, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 89 days.

(21) Appl. No.: 14/298,228

(22) Filed: Jun. 6, 2014

(65) Prior Publication Data

US 2015/0351546 A1 Dec. 10, 2015

(51) Int. Cl.
*A47C 1/026* (2006.01)

(52) U.S. Cl.
CPC ..... *A47C 1/026* (2013.01)

(58) Field of Classification Search
CPC ..... A47C 1/026
USPC ..... 297/325, 373, 257, 354.12
See application file for complete search history.

(56) References Cited

U.S. PATENT DOCUMENTS

| | | | | | |
|---|---|---|---|---|---|
| 1,642,150 | A * | 9/1927 | Irvine | A47C 7/402 | 297/371 |
| 1,678,006 | A * | 7/1928 | Headley | A47C 1/026 | 297/358 |
| 2,329,673 | A * | 9/1943 | Wood | A47C 1/026 | 267/142 |
| 2,777,504 | A * | 1/1957 | Herider | A47C 1/026 | 297/365 |
| 3,361,473 | A * | 1/1968 | Dudouyt | A47C 1/026 | 297/373 |

* cited by examiner

*Primary Examiner* — Timothy J Brindley
(74) *Attorney, Agent, or Firm* — Harness, Dickey & Pierce, P.L.C.

(57) ABSTRACT

An article of furniture may include a seat link and a seatback link. The seat link may include first, second and third apertures. The seatback link may be rotatably coupled to the seat link and may include fourth, fifth and sixth apertures. The seatback link and a seatback frame may be rotatable relative to the seat link and a seat-bottom frame among a first position in which only the first and fourth apertures are coaxially aligned, a second position in which only the second and fifth apertures are coaxially aligned, and a third position in which only the third and sixth apertures are coaxially aligned. The seatback link may be rotationally locked relative to the seat link by inserting a fastener in the first and fourth apertures in the first position, the second and fifth apertures in the second position, and the third and sixth apertures in the third position.

35 Claims, 8 Drawing Sheets

FURNITURE MEMBER SEATBACK LINKAGE WITH SELECTABLE FASTENER LOCATIONS FOR ADJUSTING SEATBACK ANGLE

FIELD

The present disclosure relates to furniture members having multiple rotatable seatbacks and linkage systems to control individual seatback positioning.

BACKGROUND

This section provides background information related to the present disclosure and is not necessarily prior art.

Conventionally, reclining articles of furniture (i.e., sofas, loveseats, and the like), referred to hereinafter generally as reclining furniture members, utilize one or more mechanisms to bias a leg rest assembly between retracted and extended positions and separate components to allow a seatback member to rotate between an upright and a fully reclined position with respect to a seat base.

In reclining furniture members having multiple sections each adapted to support a separate occupant, each section can include its own seatback member, and each seatback member can be either of a fixed position design or a rotatable design. Due to construction tolerances and the quantity of stack-up dimensions required to operate the multiple linkages of a common reclining furniture member seatback member, the actual position of each seatback member at a nominal or upright position can vary by up to approximately 4 degrees from one or more of the other seatback members. This misalignment between seatback members can be visually noticeable to the furniture member owner and/or occupant.

SUMMARY

This section provides a general summary of the disclosure, and is not a comprehensive disclosure of its full scope or all of its features.

In one form, the present disclosure provides an article of furniture that may include a seat-bottom frame, a seatback frame, a seat link, a seatback link, and a fastener. The seat link may include first, second and third apertures. The seatback link may be rotatably coupled to the seat link and may include an arm portion and a leg portion. The arm portion may support the seatback frame. The leg portion may include fourth, fifth and sixth apertures. The seatback link and the seatback frame may be rotatable relative to the seat link and the seat-bottom frame among a first position in which only the first and fourth apertures are coaxially aligned, a second position in which only the second and fifth apertures are coaxially aligned, and a third position in which only the third and sixth apertures are coaxially aligned. The fastener may selectively rotationally lock the seatback link relative to the seat link in one of the first, second and third positions by being received in the first and fourth apertures in the first position, the second and fifth apertures in the second position, and the third and sixth apertures in the third position.

In some embodiments, the fastener may be a thumbscrew that a user can threadably tighten and loosen by hand without tools.

In some embodiments, a first end of the seat link is rotatably connected to a junction between the leg portion of the seatback link and an integrally connected arm portion of the seatback link using a first rotational fastener. A longitudinal axis of the first rotational fastener defines an axis of rotation between the seatback link and the seat link.

In some embodiments, rotating the seatback link relative to the seat link between the first and second positions causes the arm portion of the seatback link to be angularly rotated by an angle of approximately one to four degrees.

In some embodiments, rotating the seatback link relative to the seat link between the first and third positions causes the arm portion of the seatback link to be angularly rotated by an angle of approximately one to four degrees.

In some embodiments, the first, second and third apertures are arranged in a linear pattern.

In some embodiments, the fourth, fifth and sixth apertures are arranged in an arcuate pattern.

In some embodiments, the arm portion and the leg portion of the seatback link are generally linear members that are angled relative to each other.

In some embodiments, a first end of the seat link is rotatably coupled to the seatback link at a junction between the arm portion and the leg portion.

In some embodiments, a second end of the seat link is coupled to a reclining mechanism.

In some embodiments, the article of furniture includes a reclining mechanism rotatably coupling the seatback frame and the seat-bottom frame.

In some embodiments, the reclining mechanism is configured to recline the seatback frame relative to the seat-bottom frame while the seatback link and the seat link are rotationally locked in one of the first, second and third positions.

In some embodiments, the first position is disposed rotationally between the second and third positions, the second aperture is disposed between the first and third apertures, and the fifth aperture is disposed between the fourth and sixth apertures.

In another form, the present disclosure provides a furniture member seatback member adjustment system that may include a seat link, a seatback link, and a seatback member. The seat link may include a first set of apertures all commonly aligned on an axis. The seatback link may include an arm portion and a leg portion having a second set of apertures arranged in an arcuate pattern. The seatback member may be rotatably connected to a furniture member frame section by the seatback link. The seatback member may include a coupling member receiving the arm portion of the seatback link. A first end of the seat link may be rotatably connected to a junction between the leg portion of the seatback link and the arm portion of the seatback link using a first rotational fastener. A longitudinal axis of the first rotational fastener defines an axis of rotation of both the seatback link and the seatback member and the seat link. When the first rotational fastener is installed, only one aperture of the first set of apertures and only one aperture of the second set of apertures can be simultaneously coaxially aligned to both receive a fastener fixing the seat link to the seatback link.

In some embodiments, moving the fastener between successive ones of the aligned pairs of apertures rotates the seatback member by approximately one to four degrees.

In some embodiments, the seatback member is angularly rotated by an angle of one to four degrees by relocating the fastener between successive ones of the aligned pairs of apertures.

In some embodiments, the fastener may be a thumbscrew that a user can threadably tighten and loosen by hand without tools.

In some embodiments, the article of furniture includes a reclining mechanism configured to recline the seatback member relative to the furniture member frame while the seatback link and the seat link are rotationally locked in one of the first, second and third positions.

In some embodiments, the arm portion and the leg portion of the seatback link are generally linear members that are angled relative to each other.

In another form, the present disclosure provide an article of furniture that may include first and second seatback frames, first and second seat-bottom frames, a reclining mechanism, a seat link, and a seatback link. The reclining mechanism may be coupled to the first seatback frame and the first seat-bottom frame and may be configured to recline the first seatback frame relative to the first seat-bottom frame and the second seatback frame. The seat link may be coupled to the reclining mechanism. The seatback link may support the first seatback frame and may be positionable relative to the seat link at first, second and third positions such that movement of the seatback link causes corresponding movement of the first seatback frame relative to the second seatback frame and the first seat-bottom frame. The reclining mechanism may be configured to recline the first seatback frame relative to the first seat-bottom frame and the second seatback frame while the seatback link is locked relative to the seat link in one of the first, second and third positions.

In some embodiments, the seatback link is movable relative to the seat link among the first, second and third positions without moving the first seat-bottom frame relative to the second seat-bottom frame.

In some embodiments, the seat link includes first, second and third apertures. The seatback link may be rotatably coupled to the seat link and may include an arm portion and a leg portion. The arm portion may support the seatback frame. The leg portion may include a fourth, fifth and sixth apertures.

In some embodiments, only the first and fourth apertures are coaxially aligned when the seatback link is in the first position, only the second and fifth apertures are coaxially aligned when the seatback link is in the second position, and only the third and sixth apertures are coaxially aligned when the seatback link is in the third position.

In some embodiments, the article of furniture includes a fastener selectively rotationally locking the seatback link relative to the seat link in one of the first, second and third positions by being received in the first and fourth apertures in the first position, the second and fifth apertures in the second position, and the third and sixth apertures in the third position.

In some embodiments, the fastener may be a thumbscrew that a user can threadably tighten and loosen by hand without tools.

In some embodiments, the first, second and third apertures are arranged in a linear pattern, and the fourth, fifth and sixth apertures are arranged in an arcuate pattern.

In some embodiments, the first position is disposed rotationally between the second and third positions. The second aperture may be disposed between the first and third apertures. The fifth aperture may be disposed between the fourth and sixth apertures.

In some embodiments, rotating the seatback link relative to the seat link between the first and second positions causes the arm portion of the seatback link to be angularly rotated by an angle of approximately one to four degrees.

In some embodiments, rotating the seatback link relative to the seat link between the first and third positions causes the arm portion of the seatback link to be angularly rotated by an angle of approximately one to four degrees.

In some embodiments, each of the first and second seatback frames includes a pair of seatback links and a pair of seat links.

In another form, the present disclosure provides a method including providing an article of furniture with first and second seatback members; and adjusting a rotational alignment of the first and second seatback members relative to each other by moving a first fastener from a first position in which the first fastener engages a pair of first apertures in a first linkage to a second position in which the first fastener engages a pair of second apertures in the first linkage.

In some embodiments, the method includes covering the first fastener and the first apertures with an upholstery after the first fastener is moved between the first and second positions.

In some embodiments, adjusting the rotational alignment includes rotating the first seatback member relative to a seat-bottom frame and the second seatback member to align the second apertures with each other after the first fastener is removed from the first apertures.

In some embodiments, the method includes rotating the second seatback member relative to the seat-bottom frame to align a pair of third apertures in a second linkage with each other; and inserting a second fastener into the third apertures.

In some embodiments, the first and second linkages are identical to each other, and the first apertures of the first linkage correspond to the third apertures of the second linkage. In some configurations, due to construction and assembly variations and/or tolerance stack-ups, rotationally aligning the first seatback with the second seatback may include inserting the first fastener in the second apertures and inserting the second fastener in the third apertures.

In some embodiments, the first seatback includes a pair of first linkages that are movable together, and the second seatback includes a pair of second linkages that are movable together.

In some embodiments, moving the fastener includes threadably loosening the first fastener by hand without tools, then removing the first fastener from the first pair of apertures, then inserting the fastener into the second pair of apertures, and then threadably tightening the first fastener by hand without tools.

In some embodiments, the first and second fastener may be thumbscrews.

In some embodiments, the furniture member includes first and second reclining mechanisms for moving the first and second seatback members relative to each other.

In some embodiments, the rotational alignment of the first and second seatback members is adjusted without actuating either of the first and second reclining mechanisms.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
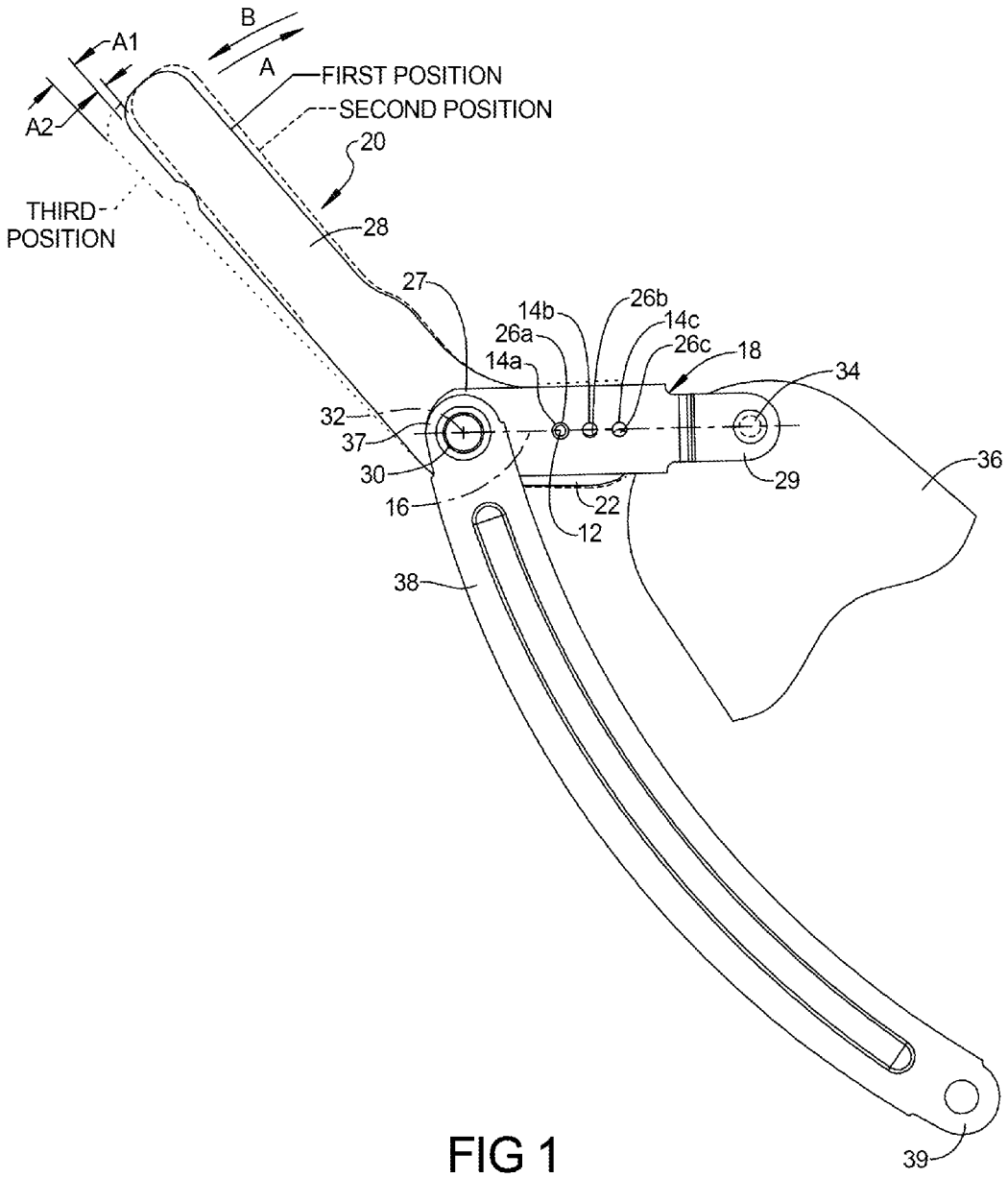
FIG. 1 is a first side view of a furniture member seatback linkage system of the present disclosure.
Figure 2:
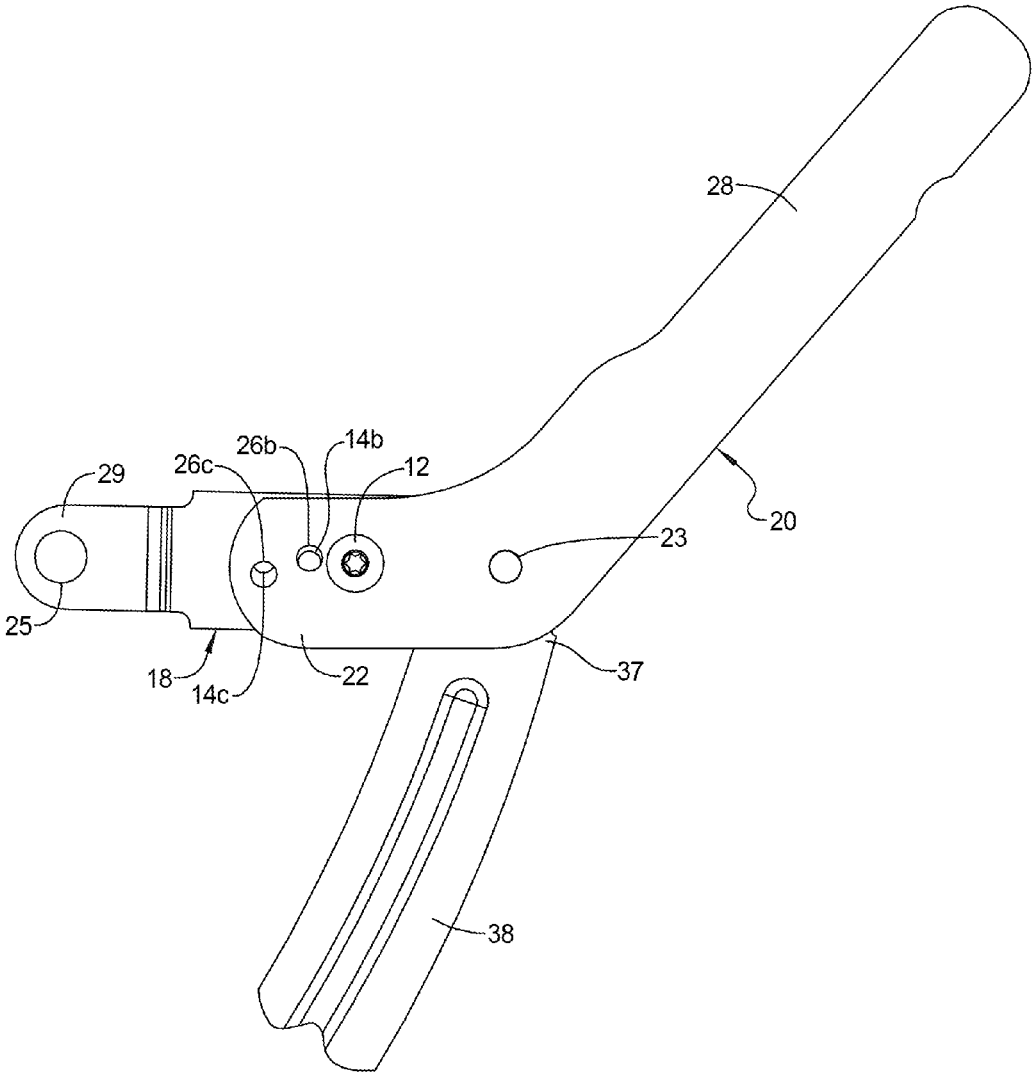
FIG. 2 is a second side view of the furniture member seatback linkage system in a first position.
Figure 3:
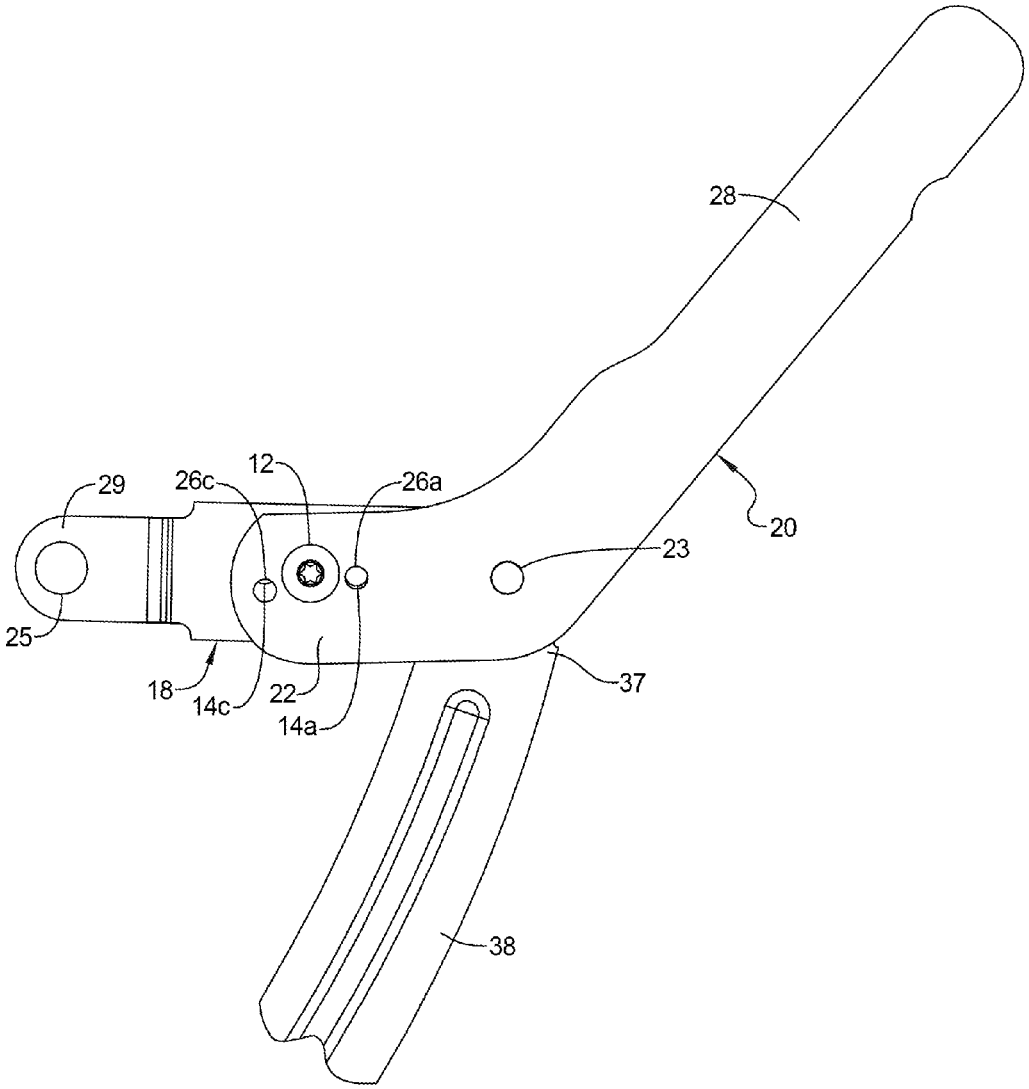
FIG. 3 is another side view of the furniture member seatback linkage system in a second position.
Figure 4:
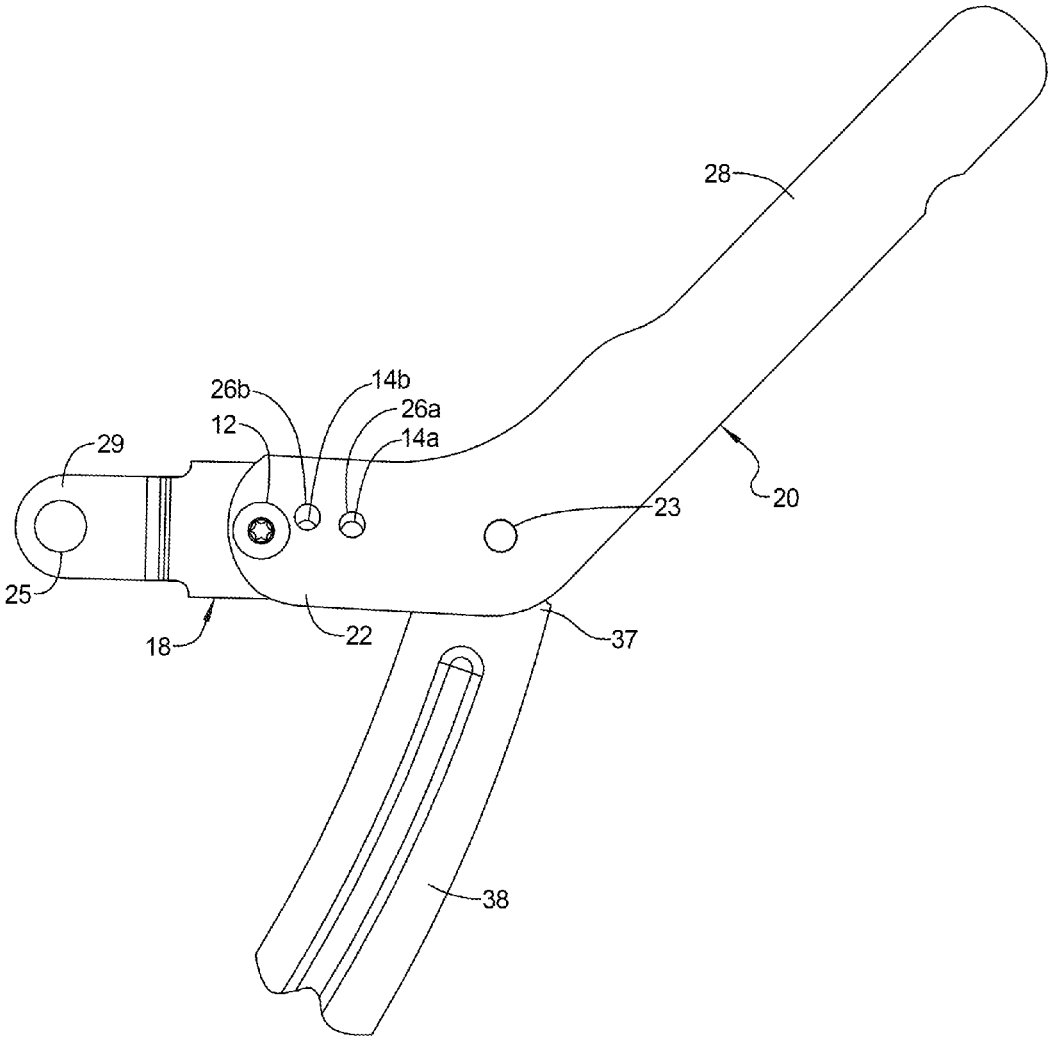
FIG. 4 is another side view of the furniture member seatback linkage system in a third position.
Figure 5:
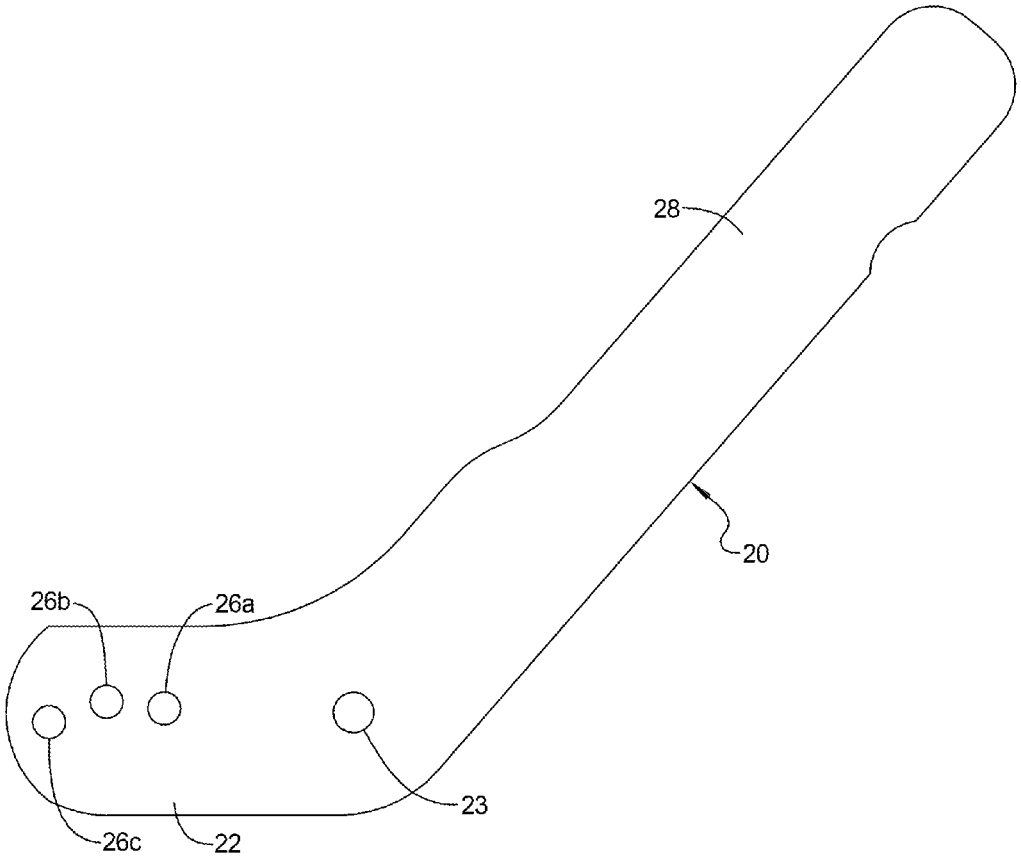
FIG. 5 is a side view of a seatback link of the furniture member seatback linkage system.

Example embodiments will now be described more fully with reference to the accompanying drawings.

Referring to FIGS. 1-5, a furniture seatback member adjustment system 10 includes a fastener 12 which is received in a selected one of a first plurality of apertures 14*a*, 14*b*, 14*c* of a seat link 18. The first apertures 14*a*, 14*b*, 14*c* may all be commonly aligned on a first axis 16 (i.e., the first axis 16 may intersect longitudinal axes of all of the first apertures 14*a*, 14*b*, 14*c*). A seatback link 20 includes a leg portion 22 (shown best in FIGS. 2-5) having a second plurality of apertures 26*a*, 26*b*, 26*c* arranged in an arcuate pattern. A first end 27 of the seat link 18 is rotatably connected to a junction between the leg portion 22 of seatback link 20 and an integrally connected arm portion 28 of seatback link 20 using a first rotational fastener 30, such that the longitudinal axis of first rotational fastener 30 defines an axis of rotation 32 between seatback link 20 and seat link 18. With the first rotational fastener 30 coupling the seatback link 20 and the seat link 18, the seatback link 20 and the seat link 18 are positionable relative to each other such that only one of pair of apertures 14*a*, 26*a*; 14*b*, 26*b* or 14*c*, 26*c* can be coaxially aligned to receive fastener 12 at any one time. That is, the seatback link 20 and seat link 18 can be moved relative to each other to a first position (FIG. 2) in which apertures 14*a*, 26*a* are coaxially aligned to receive fastener 12. The seatback link 20 and seat link 18 can be moved relative to each other to a second position (FIG. 3) in which apertures 14*b*, 26*b* are coaxially aligned to receive fastener 12. The seatback link 20 and seat link 18 can be moved relative to each other to a third position (FIG. 4) in which apertures 14*c*, 26*c* are coaxially aligned to receive fastener 12.

By appropriately selecting the aligned pairs of apertures that receive fastener 12, an arm portion 28 of seatback link 20 can be offset by a first angle A1 (FIG. 1)(e.g., about two degrees or about one to four degrees) by rotating the seatback link 20 relative to the seat link 18 from the first position (where the fastener 12 is received in apertures 14*a*, 26*a*) to the third position (where the fastener 12 is received in apertures 14*c*, 26*c*). The arm portion 28 of seatback link 20 can be offset by a second angle A2 (e.g., about two degrees or about one to four degrees) by rotating the seatback link 20 relative to the seat link 18 from the first position (where the fastener 12 is received in apertures 14*a*, 26*a*) to the second position (where the fastener 12 is received in apertures 14*b*, 26*b*). In some configurations, the fastener 12 may be a thumbscrew, for example, that a user can threadably tighten and loosen by hand without tools to move the fastener 12 among the pairs of apertures.

Seat link 18 is also rotatably connected at a second end 29 using a second rotational fastener 34 to a link mounting plate 36 (i.e., the fastener 34 is received in an aperture 25 in the seat link 18 and an aperture (not shown) in the link mounting plate 36). The link mounting plate 36 may be a component of a reclining mechanism 48 (described below). The seat link 18 and the seatback link 20 are further rotatably coupled to a first end 37 of an arcuate link 38 (i.e., a first rotational fastener 30 is received through an aperture (not shown) in the seat link 18 and an aperture 23 in the seatback link 20). While not shown in the figures, a second end 39 of the arcuate link 38 may also be connected to the link mounting plate 36. The arcuate link 38 allows rotation of a seatback member of a furniture member, which will be described in greater detail with reference to FIGS. 6-7.

As shown in FIG. 1, the arm portion 28 of seatback link 20 can therefore be rotatably displaced in either of a first adjustment direction "A" or oppositely in a second link adjustment direction "B". According to several aspects, the selected location of fastener 12 provides for a range of rotational motion of the arm portion 28 of the seatback link 20 to allow for adjustment of a seatback member shown and described in reference to FIGS. 6-8.

Figure 6:
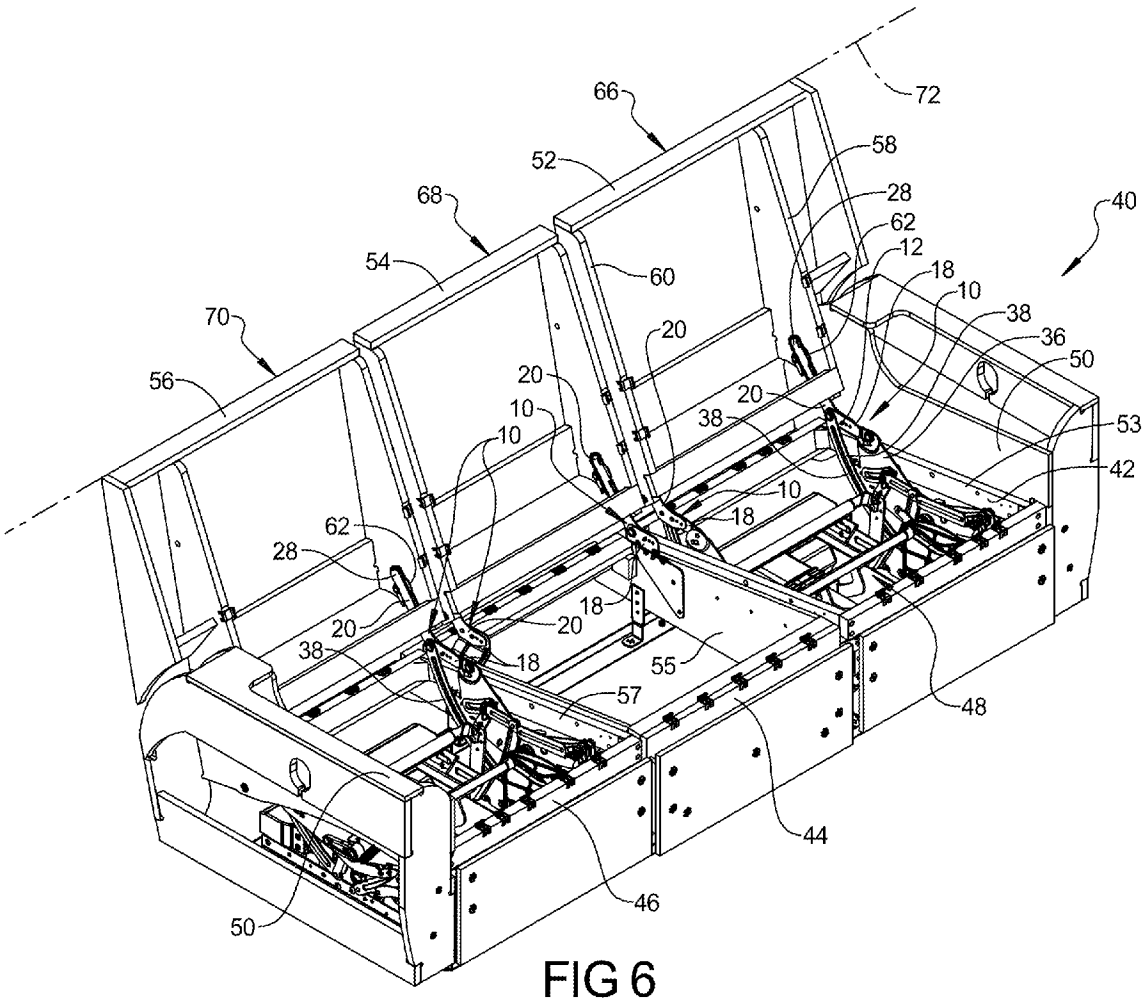
FIG. 6 is a front right perspective view of a multiple section furniture member having multiple seatback member seatback linkage systems of FIG. 1.
Figure 7:
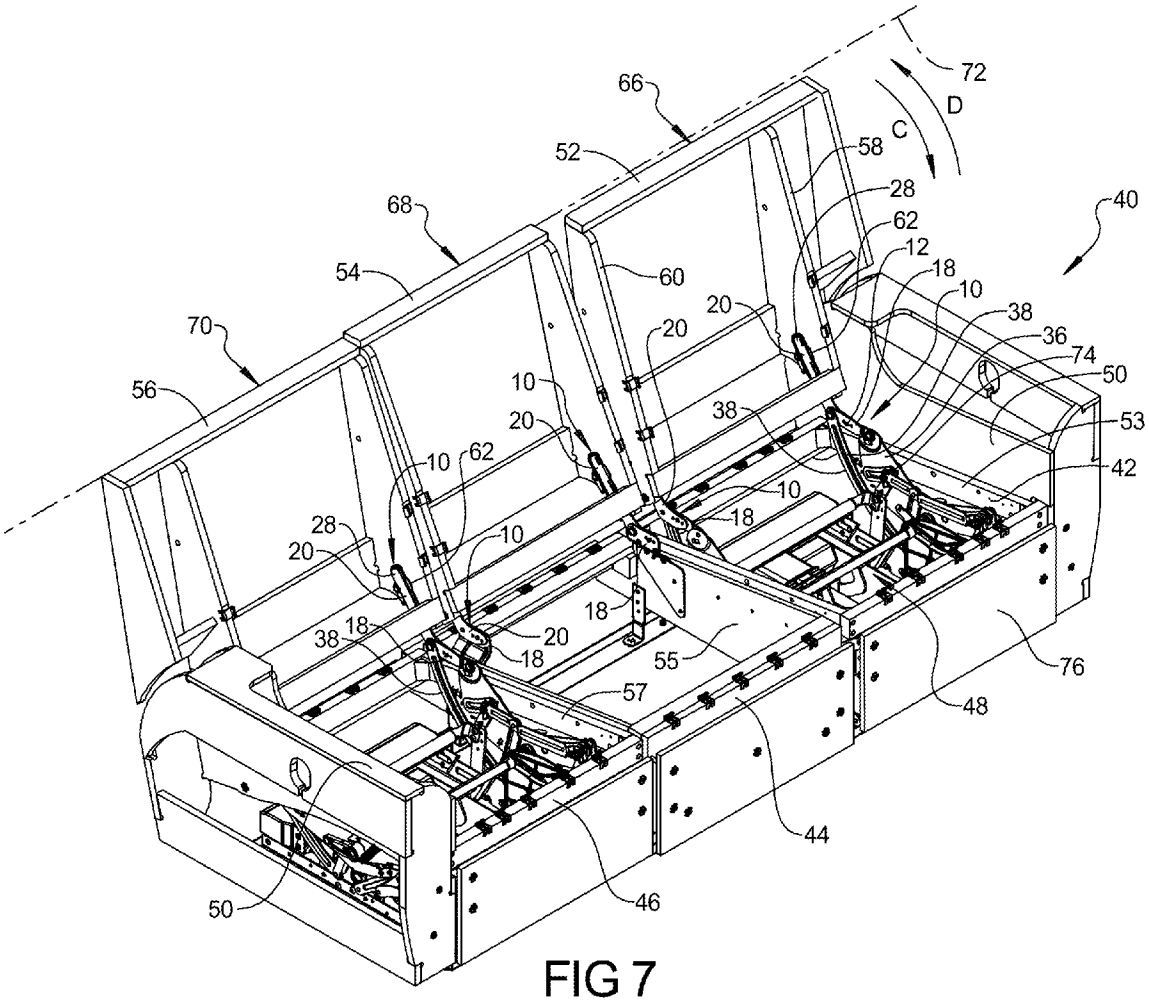
FIG. 7 is a front right perspective view of the furniture member of FIG. 6 having one of the seatback members adjusted to a furthest forward position.
Figure 8:
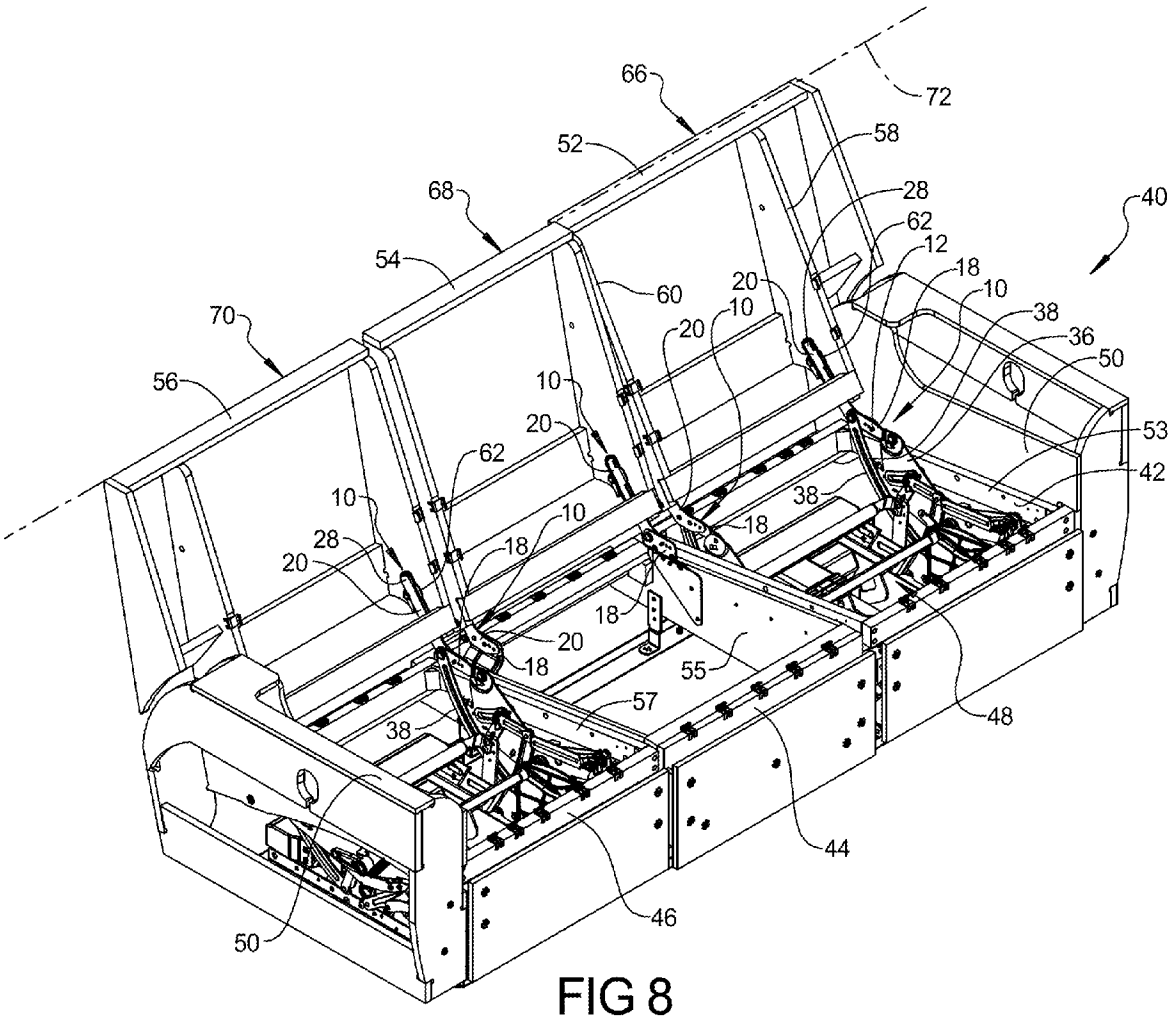
FIG. 8 is a front right perspective view of the furniture member of FIG. 6 having one of the seatback members adjusted to a furthest rearward position.

Referring to FIGS. 6-8, furniture member 40, which is shown for example as a multi-sectional couch or sofa, provides an exemplary embodiment for installation of a plurality of seatback member adjustment systems 10. It is noted that furniture member 40 can also be any other type of furniture member including a reclining chair, a gliding chair, or loveseat. In the particular embodiment shown, the furniture member 40 includes first, second, and third frame sections 42, 44, 46, which may be provided for each of three occupants of the furniture member 40. A reclining mechanism 48 can be provided with any one of or each of the first, second, and/or third furniture member frame sections 42, 44, 46. Each mechanism 48 provides for movement of various components supported by each of the frame sections. In some embodiments, one or all of the frame sections 42, 44, 46 may not include a reclining mechanism 48. The first and third frame sections 42, 46 can also include one or more arm rests 50.

Independent operation of each reclining mechanism 48 provides for rotation of individual ones of a first, second, and third seatback member 52, 54, 56, each individually and rotatably connected to first, second and third seat-bottom frames 53, 55, 57, respectively, of the first, second, or third furniture member frame sections 42, 44, 46. Each of the seatback members 52, 54, 56 can include a pair of adjustment systems 10 (i.e., a seat link 18 and seatback link 20 disposed on each opposing side of each seatback member 52, 54, 56). Each seatback member 52, 54, 56 includes a first seatback frame member 58 and a mirror image second seatback frame member 60. In the embodiment shown, the arm portion 28 of seatback link 20 is slidingly received in a coupling member 62 connected to first seatback frame member 58, while another seatback link 20 is similarly coupled using a second coupling member (not visible in this view) similarly connected to second seatback frame member 60. In any of the first, second, and/or third frame sections 42, 44, 46 not having a mechanism 48, such as second frame section 44 shown, the corresponding seatback member (seatback member 54) can still be provided with seatback member adjustment systems 10 to permit adjustment of seatback member 54 with respect to the other seatback members.

The individual positions of the first, second, and third seatback members 52, 54, 56 can vary with respect to each other based on construction and stack-up tolerances such that a seatback rear edge 66 of first seatback member 52 can be misaligned with respect to a seatback rear edge 68 of second seatback member 54 and/or with respect to a seatback rear edge 70 of third seatback member 56. For a visually aesthetic reason, it is desirable that each of the seatback rear edges 66, 68, 70 align with respect to a reference line 72 at the seatback upright positions shown.

The seatback member adjustment system 10, provided with each of the first, second, and third frame sections 42, 44, 46, allows for individual adjustment of each of the seatback rear edges 66, 68, 70 to align the seatback rear edges 66, 68, 70 on reference line 72, as shown in FIG. 6. This alignment can be performed at the factory during assembly of the furniture member 40, or also can be performed at the point of sale of furniture member 40. The common alignment of each of the seatback rear edges 66, 68, 70 is therefore desirable to provide an aesthetically optimal condition for furniture member 40 at a nominal or upright operating position. Each pair of seatback member adjustment systems 10 can therefore provide for individual adjustment of the first, second, and/or third seatback members 52, 54, 56 to provide this alignment.

The first seatback member 52 is shown in FIG. 7 in a forward-most adjusted or rotated position reached by use of two seatback member adjustment systems 10 of first seatback member 52, which provide seatback rotation in a seatback forward rotation direction "C". The first seatback member 52 has its seatback rear edge 66 rotated forward by angle A2 of the seatback rear edges 68, 70 of the second and third seatback members 54, 56 by rotation of the seatback links 20 with respect to the axis of rotation of the first rotational fasteners 30 of first seatback member 52 to the second position (FIG. 3) in which the fastener 12 is received in apertures 14*b*, 26*b*. This represents a maximum forward adjusted position permitted by seatback member adjustment systems 10.

The first seatback member 52 is shown in FIG. 8 in a rearward-most adjusted or rotated position reached by use of two seatback member adjustment systems 10 of first seatback member 52, which provide seatback rotation in a seatback forward rotation direction "D". The first seatback member 52 has its seatback rear edge 66 rotated forward by angle A1 of the seatback rear edges 68, 70 of the second and third seatback members 54, 56 by rotation of the seatback links 20 with respect to the axis of rotation of the first rotational fasteners 30 of first seatback member 52 to the third position (FIG. 4) in which the fastener 12 is received in apertures 14*c*, 26*c*. This represents a maximum rearward adjusted position permitted by seatback member adjustment systems 10.

It will be appreciated that, due to construction and assembly variations and/or tolerance stack-ups, the furniture seatback member adjustment system 10 corresponding to one or more of the first, second, and third seatback members 52, 54, 56 may need to be adjusted to a different position that one or more others of the first, second, and third seatback members 52, 54, 56 in order to align the all of the first, second, and third seatback members 52, 54, 56 in a straight line, as shown in FIG. 7. That is, the construction and assembly variations and/or tolerance stack-ups of a particular furniture member 40 may dictate that the adjustment system 10 of the first seatback member 52 should be placed in the first position (for example) while the adjustment system 10 of the third seatback member 56 may need to be placed in the second position (for example) in order to align all three of the first, second and third seatback members 52, 54, 56.

Additionally or alternatively, the adjustment systems 10 of one or more of the seatback members 52, 54, 56 can be adjusted to a position that provides most comfort for a particular user or owner of the furniture member 40. For example, some users may find the furniture member 40 most comfortable with the adjustment systems 10 of one or more of seatback members 52, 54, 56 in the first position (i.e., in the forward-most position), while other users may find the furniture member 40 most comfortable with the adjustment systems 10 of one or more of seatback members 52, 54, 56 in the second position (i.e., in the nominal position) or the third position (i.e., in the rearward-most position). Therefore, the adjustment systems 10 can be advantageously incorporated into articles of furniture including one or more reclining mechanisms 48 (or any other reclining mechanism) as well as articles of furniture that do not include reclining mechanisms 48 (or any other reclining mechanism) or sections of an article of furniture that do not include a reclining mechanism 48 (or any other reclining mechanism).

A linkage set 74 rotatably connects the mechanism 48 to other movable components of the furniture member 40 such as a legrest assembly 76 which is movable from the stowed position shown to a fully extended position known in the art. It is noted that mechanisms 48 are not operated to achieve the adjustment provided by seatback member adjustment system 10. It is further noted that the arm rest 50 is fixed such that adjustment of the first seatback member 52 with respect to the seatback forward or rearward rotation directions "C" or "D" only involves adjustment motion of the first seatback member 52. The first seatback member 52, as well as the remaining second and third seatback members 54, 56, can be individually adjusted in either the seatback forward rotation direction "C" or oppositely rotated in seatback rearward rotation direction "D" to achieve alignment with respect to reference line 72 by the adjustment provided by the two seatback member adjustment systems 10 associated with each of the first, second, or third furniture member frame sections 42, 44, 46.

It is also noted furniture member 40 is commonly covered by upholstery (e.g., fabric or leather) which is not shown for clarity. A rearmost facing portion of the upholstery (not shown) will therefore visually present the relative position of the each of the seatback rear edges 66, 68, 70.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of furniture comprising:

a seat-bottom frame;

a seatback frame;

a seat link having first, second and third apertures;

a seatback link rotatably coupled to the seat link and including an arm portion and a leg portion, the arm portion supporting the seatback frame, the leg portion having fourth, fifth and sixth apertures, the seatback link and the seatback frame being rotatable relative to the seat link and the seat-bottom frame among a first position in which only the first and fourth apertures are coaxially aligned, a second position in which only the second and fifth apertures are coaxially aligned, and a third position in which only the third and sixth apertures are coaxially aligned;

a fastener selectively rotationally locking the seatback link relative to the seat link in one of the first, second and third positions by being received in the first and fourth apertures in the first position, the second and fifth apertures in the second position, and the third and sixth apertures in the third position; and a reclining mechanism rotatably coupling the seatback frame and the seat-bottom frame, the reclining mechanism is configured to recline the seatback frame relative to the seat-bottom frame while the seatback link and the seat link are rotationally locked in one of the first, second and third positions.

2. The article of furniture of claim 1, wherein a first end of the seat link is rotatably connected to a junction between the leg portion of the seatback link and an integrally connected arm portion of the seatback link using a first rotational fastener, a longitudinal axis of the first rotational fastener defining an axis of rotation between the seatback link and the seat link.

3. The article of furniture of claim 1, wherein rotating the seatback link relative to the seat link between the first and second positions while the seatback link is rotationally unlocked from the seat link causes the arm portion of the seatback link to be angularly rotated by an angle of approximately one to four degrees.

4. The article of furniture of claim 3, wherein rotating the seatback link relative to the seat link between the first and third positions while the seatback link is rotationally unlocked from the seat link causes the arm portion of the seatback link to be angularly rotated by an angle of approximately one to four degrees.

5. The article of furniture of claim 1, wherein the first, second and third apertures are arranged in a linear pattern.

6. The article of furniture of claim 5, wherein the fourth, fifth and sixth apertures are arranged in an arcuate pattern.

7. The article of furniture of claim 1, wherein the arm portion and the leg portion of the seatback link are generally linear members that are angled relative to each other.

8. The article of furniture of claim 7, wherein a first end of the seat link is rotatably coupled to the seatback link at a junction between the arm portion and the leg portion.

9. The article of furniture of claim 8, wherein a second end of the seat link is coupled to the reclining mechanism.

10. The article of furniture of claim 1, wherein the first position is disposed rotationally between the second and third positions, and wherein the second aperture is disposed between the first and third apertures, and wherein the fifth aperture is disposed between the fourth and sixth apertures.

11. The article of furniture of claim 1, wherein the fastener is a thumbscrew.

12. A furniture member seatback member adjustment system, comprising:

a seat link having a first set of apertures all commonly aligned on an axis;

a seatback link including an arm portion and a leg portion having a second set of apertures arranged in an arcuate pattern;

a seatback member rotatably connected to a furniture member frame section by the seatback link, the seatback member having a coupling member receiving the arm portion of the seatback link;

a first end of the seat link is rotatably connected to a junction between the leg portion of the seatback link and the arm portion of the seatback link using a first rotational fastener, a longitudinal axis of the first rotational fastener defining an axis of rotation of the seatback link, the seatback member and the seat link;

wherein when the first rotational fastener is installed, only one aperture of the first set of apertures and only one aperture of the second set of apertures can be simultaneously coaxially aligned to both receive a fastener fixing the seat link to the seatback link.

13. The furniture member seatback member adjustment system of claim 12, wherein moving the fastener between successive ones of the aligned pairs of apertures rotates the seatback member by approximately one to four degrees.

14. The furniture member seatback member adjustment system of claim 12, wherein by relocating the fastener between successive ones of the aligned pairs of apertures, the seatback member is angularly rotated by an angle of one to four degrees.

15. The furniture member seatback member adjustment system of claim 12, further comprising a reclining mechanism configured to recline the seatback member relative to the furniture member frame while the seatback link and the seat link are rotationally locked relative to each other.

16. The furniture member seatback member adjustment system of claim 12, wherein the arm portion and the leg portion of the seatback link are generally linear members that are angled relative to each other.

17. The furniture member seatback member adjustment system of claim 12, wherein the fastener is a thumbscrew.

18. An article of furniture comprising:

a seat-bottom frame;

a seatback frame;

a seat link having first, second and third apertures;

a seatback link rotatably coupled to the seat link and including an arm portion and a leg portion, the arm portion supporting the seatback frame, the leg portion having fourth, fifth and sixth apertures, the seatback link and the seatback frame being rotatable relative to the seat link and the seat-bottom frame among a first position in which only the first and fourth apertures are coaxially aligned, a second position in which only the second and fifth apertures are coaxially aligned, and a third position in which only the third and sixth apertures are coaxially aligned; and a fastener selectively rotationally locking the seatback link relative to the seat link in one of the first, second and third positions by being received in the first and fourth apertures in the first position, the second and fifth apertures in the second position, and the third and sixth apertures in the third position, wherein a first end of the seat link is rotatably connected to a junction between the leg portion of the seatback link and an integrally connected arm portion of the seatback link using a first rotational fastener, a longitudinal axis of the first rotational fastener defining an axis of rotation between the seatback link and the seat link.

19. The article of furniture of claim 18, wherein the first end of the seat link is rotatably coupled to the seatback link at the junction between the arm portion and the leg portion.

20. The article of furniture of claim 19, wherein a second end of the seat link is coupled to a reclining mechanism.

21. The article of furniture of claim 20, wherein the arm portion and the leg portion of the seatback link are generally linear members that are angled relative to each other.

22. The article of furniture of claim 21, wherein the reclining mechanism rotatably couples the seatback frame and the seat-bottom frame, the reclining mechanism is configured to recline the seatback frame relative to the seat-bottom frame while the seatback link and the seat link are rotationally locked in one of the first, second and third positions.

23. The article of furniture of claim 18, wherein the first position is disposed rotationally between the second and third positions, and wherein the second aperture is disposed between the first and third apertures, and wherein the fifth aperture is disposed between the fourth and sixth apertures.

24. The article of furniture of claim 18, wherein the fastener is a thumbscrew.

25. The article of furniture of claim 18, wherein rotating the seatback link relative to the seat link between the first and second positions while the seatback link is rotationally unlocked from the seat link causes the arm portion of the seatback link to be angularly rotated by an angle of approximately one to four degrees.

26. The article of furniture of claim 25, wherein rotating the seatback link relative to the seat link between the first and third positions while the seatback link is rotationally unlocked from the seat link causes the arm portion of the seatback link to be angularly rotated by an angle of approximately one to four degrees.

27. The article of furniture of claim 18, wherein the first, second and third apertures are arranged in a linear pattern.

28. The article of furniture of claim 27, wherein the fourth, fifth and sixth apertures are arranged in an arcuate pattern.

29. An article of furniture comprising:

a seat-bottom frame;

a seatback frame;

a seat link having first, second and third apertures;

a seatback link rotatably coupled to the seat link and including an arm portion and a leg portion, the arm portion supporting the seatback frame, the leg portion having fourth, fifth and sixth apertures, the seatback link and the seatback frame being rotatable relative to the seat link and the seat-bottom frame among a first position in which only the first and fourth apertures are coaxially aligned, a second position in which only the second and fifth apertures are coaxially aligned, and a third position in which only the third and sixth apertures are coaxially aligned; and a fastener selectively rotationally locking the seatback link relative to the seat link in one of the first, second and third positions by being received in the first and fourth apertures in the first position, the second and fifth apertures in the second position, and the third and sixth apertures in the third position, wherein the arm portion and the leg portion of the seatback link are generally linear members that are angled relative to each other, and wherein a first end of the seat link is rotatably coupled to the seatback link at a junction between the arm portion and the leg portion.

30. The article of furniture of claim 29, wherein a second end of the seat link is coupled to a reclining mechanism.

31. The article of furniture of claim 29, wherein rotating the seatback link relative to the seat link between the first and second positions while the seatback link is rotationally unlocked from the seat link causes the arm portion of the seatback link to be angularly rotated by an angle of approximately one to four degrees.

32. The article of furniture of claim 31, wherein rotating the seatback link relative to the seat link between the first and third positions while the seatback link is rotationally unlocked from the seat link causes the arm portion of the seatback link to be angularly rotated by an angle of approximately one to four degrees.

33. The article of furniture of claim 29, wherein the first, second and third apertures are arranged in a linear pattern.

34. The article of furniture of claim 33, wherein the fourth, fifth and sixth apertures are arranged in an arcuate pattern.

35. The article of furniture of claim 34, further comprising a reclining mechanism rotatably coupling the seatback frame and the seat-bottom frame, the reclining mechanism is configured to recline the seatback frame relative to the seat-bottom frame while the seatback link and the seat link are rotationally locked in one of the first, second and third positions.

* * * * *